US010060242B2

(12) United States Patent
Benoit et al.

(10) Patent No.: US 10,060,242 B2
(45) Date of Patent: Aug. 28, 2018

(54) TRACEABLE METAL-ORGANIC FRAMEWORKS FOR USE IN SUBTERRANEAN FORMATIONS

(71) Applicant: Halliburton Energy Services, Inc., Houston, TX (US)

(72) Inventors: Denise Nicole Benoit, Houston, TX (US); Nathan Carl Schultheiss, Kingwood, TX (US); Zheng Lu, Kingwood, TX (US); Humberto Almeida Oliveira, Minas Gerais (BR); Chandra Sekhar Palla-Venkata, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/523,530

(22) PCT Filed: Dec. 5, 2014

(86) PCT No.: PCT/US2014/068769
§ 371 (c)(1),
(2) Date: May 1, 2017

(87) PCT Pub. No.: WO2016/089418
PCT Pub. Date: Jun. 9, 2016

(65) Prior Publication Data

US 2017/0350225 A1 Dec. 7, 2017

(51) Int. Cl.
*E21B 47/09* (2012.01)
*E21B 43/26* (2006.01)

(52) U.S. Cl.
CPC ..... *E21B 43/26* (2013.01); *E21B 47/0905* (2013.01)

(58) Field of Classification Search
None
See application file for complete search history.

(56) References Cited

U.S. PATENT DOCUMENTS

2004/0129923 A1 7/2004 Nguyen et al.
2009/0218094 A1 9/2009 McLeod et al.
(Continued)

FOREIGN PATENT DOCUMENTS

WO 2007/105167 A2 9/2007
WO 2016/010525 A1 1/2016

OTHER PUBLICATIONS

Tan, Jin Chong, and Anthony K. Cheetham. "Mechanical properties of hybrid inorganic-organic framework materials: establishing fundamental structure-property relationships." Chemical Society Reviews 40.2 (2011): 1059-1080.
(Continued)

*Primary Examiner* — Angela M DiTrani
*Assistant Examiner* — Andrew Sue-Ako
(74) *Attorney, Agent, or Firm* — Craig Roddy; Baker Botts L.L.P.

(57) ABSTRACT

Systems and methods for the use of traceable metal-organic frameworks in subterranean formations are provided. In one embodiment, the methods comprise: introducing a fluid into a wellbore penetrating at least a portion of a subterranean formation, the fluid comprising a base fluid and a solid particle comprising a metal-organic framework comprising at least one detectable component, wherein the metal-organic framework further comprises at least one metal ion and an organic ligand that is at least bidentate and that is bonded to the metal ion; and detecting one or more signals from the at least one detectable component.

20 Claims, 2 Drawing Sheets

(56) References Cited

U.S. PATENT DOCUMENTS

| | | | | |
|---|---|---|---|---|
| 2009/0288820 | A1* | 11/2009 | Barron | B01J 13/02 166/249 |
| 2010/0226991 | A1* | 9/2010 | Horcajada-Cortes | C07F 15/025 424/489 |
| 2011/0001040 | A1 | 1/2011 | Smith, Jr. et al. | |
| 2012/0052006 | A1* | 3/2012 | Boyes | A61K 49/0002 424/1.29 |
| 2012/0259117 | A1* | 10/2012 | Yaghi | C07F 15/006 546/8 |
| 2013/0204025 | A1* | 8/2013 | Buso | C07F 3/003 556/130 |
| 2013/0340997 | A1 | 12/2013 | Zupanick | |
| 2014/0326007 | A1 | 11/2014 | Dinca et al. | |
| 2015/0240147 | A1* | 8/2015 | Jiang | C09K 8/68 166/308.3 |

OTHER PUBLICATIONS

Liu, Demin, et al. "Metal-organic frameworks as sensory materials and imaging agents." Inorganic chemistry 53.4 (2014): 1916.

Saldungaray, Pedro, Terry Palisch, and Robert Duenckel. "Novel Traceable Proppant Enables Propped Frac Height Measurement While Reducing the Environmental Impact." SPE/EAGE European Unconventional Resources Conference & Exhibition—From Potential to Production. 2012.

Perfetto, R., et al. "Fracture Optimization Applying a Novel Traceable Proppant and a Refined Mechanical Earth Model in the Congo Onshore." IPTC 2013: International Petroleum Technology Conference. 2013.

Duenckel, Robert J., et al. "Environmental stewardship: Global applications of a nonradioactive method to identify proppant placement and propped-fracture height." SPE Production & Operations 29.04 (2014): 231-242.

Duenckel, Robert John, et al. "Field Application of a New Proppant Detection Technology." SPE Annual Technical Conference and Exhibition. Society of Petroleum Engineers, 2011.

Bartko, Kirk, et al. "Hydraulic Fracture Geometry Evaluation Using Proppant Detection: Experiences in Saudi Arabia." SPE Saudi Arabia Section Technical Symposium and Exhibition. Society of Petroleum Engineers, 2013.

Duenckel Robert J., et al. "A New Nuclear Method to Locate Proppant Placement in Induced Fractures." SPE/DGS Saudi Arabia Section Technical Symposium and Exhibition. Society of Petroleum Engineers, 2011.

International Search Report and Written Opinion issued in related PCT Application No. PCT/US2014/068769 dated Jul. 31, 2015, 17 pages.

International Preliminary Report on Patentability issued in related Application No. PCT/US2014/068769, dated Jun. 15, 2017 (13 pages).

Magnetic Resonance Imaging, National Institute of Biomedical Imaging and Bioengineering, https://www.nibib.nih.gov/science-education/science-topics/magnetic-resonance-imaging-mri (last visited Mar. 2, 2018), 3 pages.

Coates, Xiao, and Prammer: NMR Logging Principles and Applications; Halliburton Energy Services Publication H02308, 1999, 251 pages.

* cited by examiner

TRACEABLE METAL-ORGANIC FRAMEWORKS FOR USE IN SUBTERRANEAN FORMATIONS

CROSS-REFERENCE TO RELATED APPLICATION

The present application is a U.S. National Stage Application of International Application No. PCT/US2014/068769 filed Dec. 5, 2014, which is incorporated herein by reference in its entirety for all purposes.

BACKGROUND

The present disclosure relates to systems and methods for use in subterranean formations, and more specifically, systems and methods for using traceable metal-organic frameworks in subterranean formations.

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

When performing subterranean operations, it is often desirable to monitor the wellbore and the formations surrounding it. Knowledge of the actual subterranean formation size, location, geometry, and conditions provides valuable data. Knowledge of the distribution and placement of fluids and materials in the wellbore and subterranean formations is also valuable. In some cases, tracers are mixed into such fluids and materials in order to detect them. However, tracers may not be suitable for the conditions in the subterranean formation and may separate from the target material, reducing the accuracy and quality of the detection.

BRIEF DESCRIPTION OF THE DRAWINGS

These drawings illustrate certain aspects of some of the embodiments of the present disclosure, and should not be used to limit or define the claims.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to systems and methods for use in subterranean formations. Particularly, the present disclosure relates to systems and methods for the use of traceable metal-organic frameworks in subterranean formations.

More specifically, the present disclosure provides methods and systems for introducing a fluid comprising a traceable metal-organic framework ("MOF") into a wellbore penetrating at least a portion of a subterranean formation. According to one embodiment, the fluid comprises a base fluid and a solid particle comprising a MOF wherein the MOF comprises at least one detectable component. In some embodiments, the MOF comprises at least one metal ion and at least one multidentate organic ligand. In certain embodiments, the detectable components may comprise traceable metal ions, traceable organic ligands, a traceable guest molecule within the framework, or any combination thereof. In certain embodiments, the MOFs are introduced in at least part of the subterranean formation, for example, via a wellbore penetrating at least a portion of the subterranean formation. While in the formation, the MOFs may emit, reflect, adsorb, and/or alter one or more signals (e.g., MRI resonance signals, gamma rays, fluorescence, and seismic or acoustic waves) which may be detected using equipment at or near the subterranean formation. The detection of these signals may allow an operator to determine, among other things, the location of the MOFs in the subterranean formation and/or other conditions in the formation.

Figure 1:
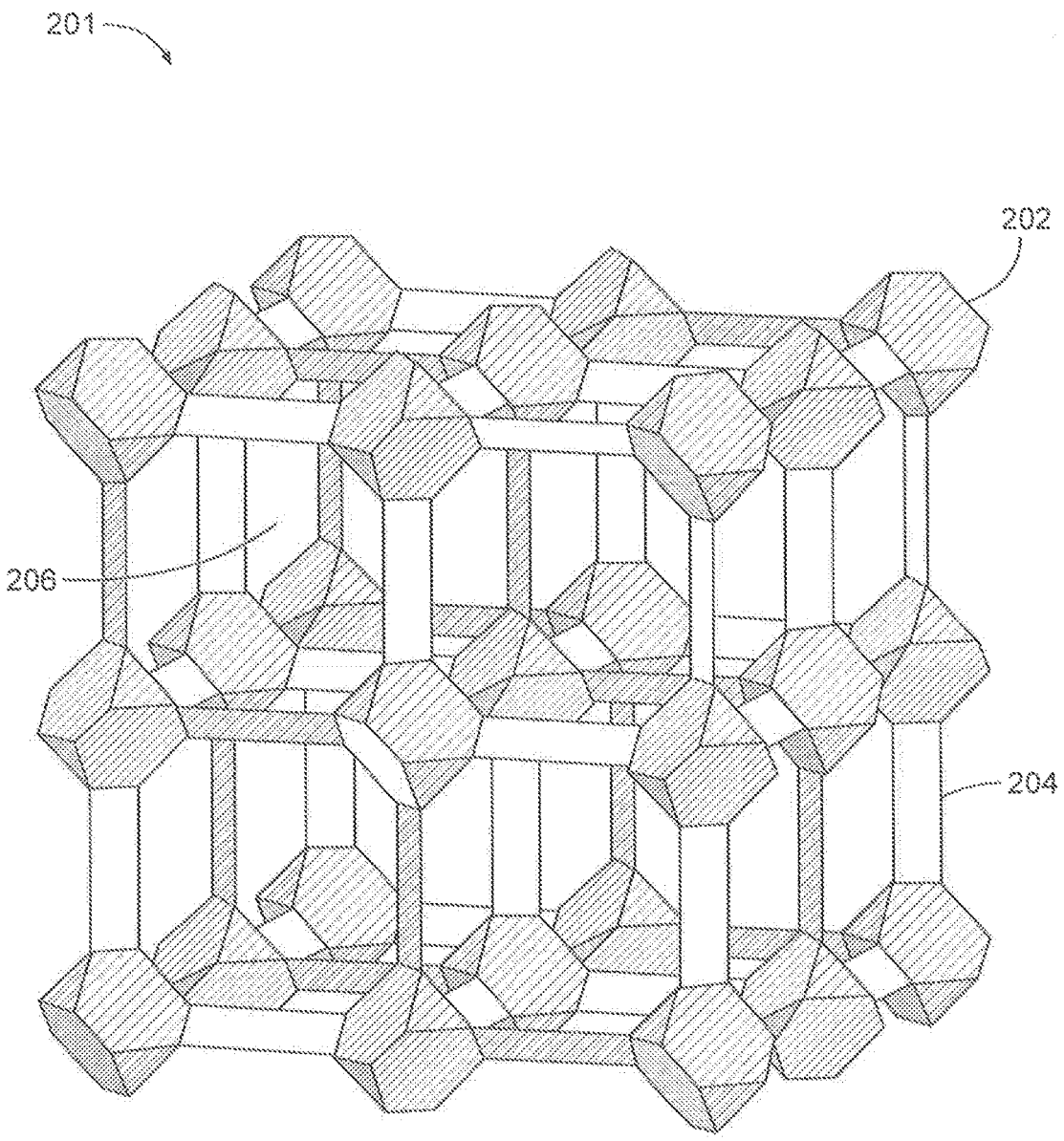
FIG. 1 is a diagram illustrating the structure of a metal-organic framework according to certain embodiments of the present disclosure.

For example, FIG. 1 depicts the structure of an embodiment of a MOF 201. The MOF 201 is shown with metal ions 202 bonded to bidentate organic ligands 204. There may be one or more guest molecules (not shown) encapsulated within the MOF 201 in a pore space 206.

The MOFs may be employed in any applicable use in subterranean operations, for example, as proppant particulates, gravel particulates, suspending agents, or the like. Such MOFs may be used, for example, as a traceable proppant in fracturing operations. In some embodiments, the one or more signals of the detectable component are then traced, for example, to determine fracture geometry, fracture growth, and/or wellbore and/or fracture conditions.

Among the many potential advantages to the methods and compositions of the present disclosure, only some of which are alluded to herein, the methods, compositions, and systems of the present disclosure may provide improved methods and systems for tracking fluid and material distribution, imaging the subterranean formation, and monitoring conditions in the same. For example, because the MOF can function both as a proppant and a traceable material, proppant distribution measurements may be more accurate than methods that require mixing a traceable material with the proppant. Another advantage of the present disclosure is its adaptability. For example, in selecting the constituents of the MOF, properties of the MOF can be tuned, including: detectability, porosity, resistivity, compressive strength, density, temperature resistance, and resistance to acidity and basicity. In certain embodiments, multiple detectable components could be used in the same MOF, enabling it to serve dual functions, such as facilitating imaging of a fracture while also providing information about subterranean conditions.

In certain embodiments, one advantage of the disclosure resides in the fact that MOFs typically are crystalline solids exhibiting low density, thereby rendering them amenable to suspension in fluids for ease of delivery to subterranean formations. Thus in some embodiments, the MOF has a dry density of about 0.2 g/cm$^3$ to about 0.8 g/cm$^3$. Consistent with this physical property, as mentioned above, MOFs according to the disclosure are relatively porous materials, wherein pore sizes are tunable by selection of metal and ligand. In one embodiment, the pore size of the MOF ranges from about 0.2 nm to about 30 nm, from about 0.5 nm to about 20 nm, and from about 0.7 nm to about 2 nm.

Some embodiments of the disclosure provide for a fluid comprising a MOF and methods of its use. The MOF may be a bulk material, which may comprise a crystalline microporous or mesoporous solid. The MOFs of the present disclosure comprise as basic or molecular units a plurality of metal ions and organic ligands that are at least bidentate in order to coordinate to the metal ions. MOFs generally exhibit high surface areas and are well-defined, rigid structures amenable to chemical and physical tuning by choice of metal and/or ligand. The units of coordinated metals and ligands may be repeated in two or three dimensions to form a lattice having pores, and the lattice thus constitutes the MOF structure.

The MOFs of the present disclosure are versatile as to properties, size of pores, and applications. In certain embodiments, the MOFs may be particularly suited for use as proppants because MOFs can be manufactured into differently shaped bodies, they can be calcined, and they exhibit high mechanical strength while simultaneously maintaining porosity toward gases and liquids, even at high temperatures. In certain embodiments, the MOF may be coated with a polymer, which may reduce reactivity. In certain embodiments, the MOF may be annealed, which may enhance durability.

Suitable metals for use in the MOFs of the present disclosure are selected from metal ions of main group elements and of the subgroup elements of the periodic table of the elements, namely of the groups Ia, IIa, IIIa, IVa to VIIIa and Ib to VIIIb, lanthanides and actinides. In some embodiments, the metal is selected from the group consisting of Li, Mg, Ca, Sr, Ba, Sc, Y, Ti, Zr, Hf, V, Nb, Ta, Cr, Mo, W, Mn, Re, Fe, Ru, Os, Co, Rh, Ir, Ni, Pd, Pt, Cu, Ag, Au, Zn, Cd, Hg, Al, Ga, In, Tl, Si, Ge, Sn, Pb, As, Sb, Bi, Gd, Eu, Tb, and any combinations thereof. Exemplary metals according to some embodiments include Al, Zn, Cu, Ni, Co, Fe, Mn, Cr, Cd, Mg, Ca, Zr, and any combinations thereof.

The MOF according to some embodiments of the disclosure comprises metal ions of these metal elements. In principle, any available ion of a given metal is contemplated for use in the disclosure. Examples of metal ions include, but are not limited to $Li^+$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^+$, $Ni^{2+}$, $Ni^+$, $Pd^{4+}$, $Pd^{2+}$, $Pd^+$, $Pt^{2+}$, $Pt^+$, $Cu^{2+}$, $Cu^+$, $Ag^+$, $Au^+$, $Zn^{2+}$, $Cd^{2+}$, $Hg^{2+}$, $Hg^+$, $Al^{3+}$, $Ga^{3+}$, $In^{3+}$, $Tl^{3+}$, $Tl^+$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^+$, $Sb^{5+}$, $Sb^{3+}$, $Sb^+$, $Bi^{5+}$, $Bi^{3+}$ $Bi^+$, $Gd^{3+}$, $Eu^{3+}$, $Tb^{3+}$, and any combinations thereof.

In principle, any compound can be used as a ligand in the MOF that fulfills the foregoing requirements. More specifically, the ligand features at least two centers that are capable of coordinating to the metal ions of a metal salt, particularly with the metals of the aforementioned groups. In some embodiments, such centers in a ligand are selected from the group consisting of carboxylates, phosphonates, amines, azides, cyanides, squaryl groups, hydroxylate, quinone, semiquinone, imidazolate, trazolate, tetrazolate, heteroatoms (e.g., N, O, and S), and any combinations thereof.

In one embodiment, the ligand is selected from the group consisting of a monocarboxylic acid, a dicarboxylic acid, a tricarboxylic acid, a tetracarboxylic acid, and an imidazole. Further contemplated in this regard are ions, salts, and combinations of such ligands. Illustrative ligands for use in the disclosure include formic acid, acetic acid, oxalic acid, propanoic acid, butanedioic acid, (E)-butenedioic acid, benzene-1,4-dicarboxylic acid, benzene-1,3-dicarboxylic acid, benzene-1,3,5-tricarboxylic acid, 2-amino-1,4-benzenedicarboxylic acid, 2-bromo-1,4-benzenedicarboxylic acid, biphenyl-4,4'-dicarboxylic acid, biphenyl-3,3',5,5'-tetracarboxylic acid, biphenyl-3,4',5-tricarboxylic acid, 2,5-dihydroxy-1,4-benzenedicarboxylic acid, 1,3,5-tris(4-carboxyphenyl)benzene, (2E,4E)-hexa-2,4-dienedioic acid, 1,4-naphthalenedicarboxylic acid, pyrene-2,7-dicarboxylic acid, 4,5,9,10-tetrahydropyrene-2,7-dicarboxylic acid, aspartic acid, glutamic acid, adenine, 4,4'-bypiridine, pyrimidine, pyrazine, pyridine-4-carboxylic acid, pyridine-3-carboxylic acid, imidazole, 1H-benzimidazole, 2-methyl-1H-imidazole, ions, salts, and any combinations thereof.

Some embodiments contemplate specific combinations of metal, ligand, and guest molecule, where at least one component is traceable. For instance, in one embodiment the metal is Gd, i.e., the metal ion is $Gd^{3+}$, and the ligand is bis(methylammonium)benzene-1,4-dicarboxylate ("BDC"), i.e., present as a bis(methylammonium)dicarboxylate dianion coordinated to $Gd^{3+}$. In certain embodiments, $Eu^{3+}$ and/or $Tb^{3+}$ may be encapsulated within Gd(BDC) after synthesis, which may make the MOF luminescent. In another embodiment, the metal ion is Cu, i.e., the metal ion is $Cu^{2+}$, and the ligand is 2,3,4,5,6-tetraiodo-1,4-benzenedicarboxylate acid, i.e., present as the corresponding dicarboxylate dianion.

Other examples of MOFs also include those based upon the following metal and ligand combinations:

$[Eu(pdc)_{1.5}]$ where pdc=pyridine-3,5-dicarboxylate;

$[Pb_2(bco)_2(bipy)]$, where bco=1,5-bis(m-carboxyphenoxy)-3-oxapentane and bipy=4,4'-bipyridine;

Tb(BTC), where BTC=benzene-1,3,5-tricarboxylate;

$Ir(ppy)_3$, where ppy=2-phenylpyridine;

$[Zn_2(bdc)_2(dpNDI)]_n$, where bdc=1,4-benzenedicarboxylate and dpNDI=N,N'-di-4-pyridyl-1,4,5,8-naphthalenediimide;

$[Gd(1,2,4\text{-}BTC)(H_2O)_3]H_2O$, where 1,2,4-BTC=tris(methylammonium)benzene-1,2,4-tricarboxylate;

$[Gd_2(bhc)(H_2O)_6]$, where bhc=benzenehexacarboxylate;

$Mn(BDC)(H_2O)_2$, where BDC=terephthalic acid; and $Mn_3(BTC)_2(H_2O)_6$, where BTC=trimesic acid.

In certain embodiments, a guest molecule may be encapsulated within a MOF. The guest molecule may be inserted into the pore space of an existing MOF or encapsulated by a MOF as it is formed. In principle, any compound or ion of suitable size and compatibility could be encapsulated in a MOF. Examples of materials that may be encapsulated within the MOF include, but are not limited to treatment chemicals (e.g., chelating agents, scale inhibitors, gel breakers, dispersants, paraffin inhibitors, wax inhibitors, hydrate inhibitors, corrosion inhibitors, de-emulsifiers, foaming agents, tracers, defoamers, delinkers, scale inhibitors, crosslinkers, surfactants, salts, acids, catalysts, clay control agents, biocides, friction reducers, flocculants, $H_2S$ scavengers, $CO_2$ scavengers, oxygen scavengers, lubricants, viscosifiers, relative permeability modifiers, wetting agents, filter cake removal agents, antifreeze agents, and any derivatives thereof), dyes, additional detectable components, additional metal ions, and the like.

In certain embodiments, the metal ions in the MOF comprise a detectable component. In principle, any metal in any of its oxidation states may be a suitable detectable component. Examples of suitable traceable metals include, but are not limited to $Li^+$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Ti^{2+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^+$, $Ni^{2+}$, $Ni^+$, $Pd^{4+}$, $Pd^{2+}$, $Pd^+$, $Pt^{4+}$, $Pt^{2+}$, $Pt^+$, $Cu^{2+}$, $Cu^+$, $Ag^+$, $Au^+$, $Zn^{2+}$, $Cd^{2+}$, $Hg^{2+}$, $Hg^+$, $Al^{3+}$, $Ga^{3+}$, $In^{3+}$, $Tl^{3+}$, $Tl^+$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^+$, $Sb^{5+}$, $Sb^{3+}$, $Sb^+$, $Bi^{5+}$, $Bi^{3+}$, $Bi^+$, $Gd^{3+}$, $Eu^{3+}$, $Tb^{3+}$, and any combinations thereof.

In certain embodiments, the organic ligands in the MOF comprise a detectable component. The detectable component of a traceable ligand may comprise a traceable element, fragment, or molecule, or any combination thereof. Examples of suitable traceable ligands include, but are not limited to perhalogenated compounds (e.g., perfluoromethylcyclopentane, tetraiodobenzenedicarboxylate), light-absorbing dyes (e.g., methylene blue), fluorescent dyes (e.g., fluorescein, rhodamine WT, eosin Y), short-chain aliphatic compounds (e.g., ethanol and propanol), chelating agents (e.g., ferrous gluconate, ferrous lactate), high thermal neutron capture compounds, and any combination thereof. In certain embodiments, the detectable component of the organic ligand can be an element and/or an isotope, including but not limited to $^{13}C$, $^{14}C$, $^{1}H$, $^{2}H$, $^{15}N$, $^{31}P$, $^{17}O$, $^{18}O$, $^{19}F$, $^{33}S$, $^{35}Cl$, $^{37}Cl$, $^{79}Br$, $^{81}Br$, $^{127}I$, and any combination thereof. In certain embodiments, the traceable ligands may be synthesized comprising a detectable component. In certain embodiments, the detectable component may be added to an existing ligand.

In certain embodiments, guest molecules in the MOF comprise a detectable component. In certain embodiments, the detectable component of the guest molecule may be an ion, element, fragment, molecule, or any combination thereof. Examples of suitable traceable guest molecules include, but are not limited to $Li^+$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Ti^{2+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^+$, $Ni^{2+}$, $Ni^+$, $Pd^{4+}$, $Pd^{2+}$, $Pd^+$, $Pt^{4+}$, $Pt^{2+}$, $Pt^+$, $Cu^{2+}$, $Cu^+$, $Ag^+$, $Au^+$, $Zn^{2+}$, $Cd^{2+}$, $Hg^{2+}$, $Hg^+$, $Al^{3+}$, $Ga^{3+}$, $In^{3+}$, $Tl^{3+}$, $Tl^+$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^+$, $Sb^{5+}$, $Sb^{3+}$, $Sb^+$, $Bi^{5+}$, $Bi^{3+}$, $Bi^+$, $Gd^{3+3+}$, $Eu^{3+}$, $Tb^{3+}$, perhalogenated compounds (e.g., perfluoromethylcyclopentane, tetraiodobenzenedicarboxylate), light-absorbing dyes (e.g., methylene blue), fluorescent dyes (e.g., fluorescein, rhodamine WT, eosin Y), mechanically-interlocked molecular architectures (e.g., rotaxane and catenane), short-chain aliphatic compounds (e.g., ethanol and propanol), chelating agents (e.g., ferrous gluconate, ferrous lactate), high thermal neutron capture compounds, and any combination thereof. In certain embodiments, the detectable component of the organic ligand can be an element and/or an isotope, including but not limited to $^{13}C$, $^{14}C$, $^{1}H$, $^{2}H$, $^{15}N$, $^{31}P$, $^{17}O$, $^{18}O$, $^{19}F$, $^{33}S$, $^{35}Cl$, $^{37}Cl$, $^{79}Br$, $^{81}Br$, $^{127}I$, and any combination thereof.

Methods and equipment for detecting the signals from the detectable component or components of the MOF may comprise any suitable method and/or equipment suitable for use with subterranean formations. In certain embodiments, this may include, but is not limited to magnetic resonance imaging, seismic imaging, x-ray computed topography, neutron capture, radioactive labeling, acoustic detection, and optical imaging (e.g., fluorescence). In some embodiments, detecting the one or more signals may comprise applying a magnetic field and detecting magnetic resonance signals.

In certain embodiments, the present disclosure may comprise sensors. For purposes of this disclosure, the term "sensors" is understood to comprise sources (to emit and/or transmit energy and/or signals), receivers (to receive and/or detect energy and/or signals), and transducers (to operate as a source and/or receiver).

In one embodiment, the detectable component comprises a fluorescent compound and the detector may be a photomultiplier fluorescence detector. Light from a light source may be configured to send light through an optical fiber and the energy collector at a given wavelength and allowed to illuminate the detectable component. The incident light may be captured by the fluorescent compound, which then re-emits the light at a second (usually longer) wavelength. The emitted light may then be captured by an optical fiber bundle and returned to a photodiode detector in order to calculate the MOF concentration within the wellbore.

In some embodiments, one or more of the detectable components is suitable to determine and image the fracture geometry, fracture growth, or proppant distribution in a subterranean formation. In certain embodiments, one or more of the detectable components is adapted to provide (e.g., emit, produce, reflect, etc.) a signal that depends at least in part on (e.g., may be altered by) one or more conditions in the wellbore and/or subterranean formation. For example, conditions may include, but are not limited to temperature, pressure, pH, density, viscosity, and the presence (or absence) of hydrocarbons, water, and/or other compounds. For example, a detectable ligand with hydrophobic bonding may at least partially dissolve when the MOF is exposed to a hydrocarbon environment in a portion of a subterranean formation, causing the detectable ligand to wash away from the rest of the MOF. Subsequently, the intensity of the signals of the detectable ligand may be reduced or eliminated, which thus may indicate the presence of the hydrocarbon in that region of the formation. In certain embodiments, for example, a detectable component of the MOF may at least partially react or dissolve with water, which may at least partially reduce the intensity of the signals from the detectable component. This may indicate the presence of water in that region of the formation.

In accordance with an embodiment, the present disclosure provides a system that uses or that can be generated by use of an embodiment of the MOF described herein in a subterranean formation, or that can perform or be generated by performance of a method for using the MOF described herein. In some embodiments, the MOF in the system comprises a downhole fluid, or the system comprises a mixture of the composition and downhole fluid. In other embodiments, the system comprises imaging equipment located at a well site communicating with one or more sensors.

In accordance with some embodiments, the present disclosure provides a system with imaging equipment. In certain embodiments, the imaging equipment may comprise a computer processor. For purposes of this disclosure, a computer processor may comprise any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. In certain embodiments, a computer processor may comprise hardware for executing instructions, such as those making up a computer program. In certain embodiments, a computer processor may be coupled to a memory device where data, software, programming, and/or executable instructions are stored. Such memory devices may comprise a hard drive, random access memory (RAM), read-only memory (ROM), or other similar storage media known in the art, and may comprise a set of instructions that when executed by the processor cause the processor to perform one or more of the actions, calculations, or steps of the methods of the present disclosure described herein. In certain embodiments, a computer processor may comprise one or more arithmetic logic units (ALUs); be a multi-core processor; or comprise one or more processors.

In some embodiments, the imaging equipment may execute instructions, for example, to generate output data based on data inputs. For example, the imaging equipment may execute or interpret software, scripts, programs, functions, executables, or other modules. In certain embodiments, input data received by the imaging equipment may comprise data from one or more sensors sensing one or more signals from a detectable component of the MOF of the present disclosure. In certain embodiments, output data generated by the imaging equipment may comprise imaging data and/or images. Images may include, but are not limited to bulk density images, gamma-ray images, photo-electric factor images, borehole caliper images, acoustic images, electrical images, magnetic resonance images, seismic images, nuclear images, ultrasonic images, velocity images, shear velocity images, thermal images, and the like, and any combinations thereof.

In some embodiments, the imaging equipment may communicate by any type of communication channel, connector, data communication network, or other link. In certain embodiments, for example, the communication may comprise a wireless or a wired network, a Local Area Network (LAN), a Wide Area Network (WAN), a private network, a public network (such as the Internet), a WiFi network, a network that comprises a satellite link, a serial link, a wireless link (e.g., infrared, radio frequency, or others), a parallel link, another type of data communication network, or any combination thereof.

To provide for interaction with a user, in certain embodiments operations may be implemented on imaging equipment having a display device (e.g., a monitor, or another type of display device) for displaying information to the user and a keyboard and a pointing device (e.g., a mouse, a trackball, a tablet, a touch sensitive screen, or another type of pointing device) by which the user may provide input to the computer. In certain embodiments, other kinds of devices may be used to provide for interaction with a user as well; for example, feedback provided to the user may be any form of sensory feedback, e.g., visual feedback, auditory feedback, or tactile feedback; and input from the user may be received in any form, including acoustic, speech, or tactile input. In addition, the imaging equipment may interact with a user by sending documents to and receiving documents from a device that is used by the user; for example, by sending web pages to a web browser on a user's client device in response to requests received from the web browser.

In some embodiments, the method or system comprises a pump. The pump is a high pressure pump in some embodiments. As used herein, the term "high pressure pump" refers to a pump that is capable of delivering a fluid to a subterranean formation (e.g., downhole) at a pressure of about 1000 psi or greater. A high pressure pump can be used when it is desired to introduce the composition to a subterranean formation at or above a fracture gradient of the subterranean formation, but it can also be used in cases where fracturing is not desired. In some embodiments, the high pressure pump can be capable of fluidly conveying particulate matter, such as proppant particulates, into the subterranean formation. Suitable high pressure pumps are known to one having ordinary skill in the art and can include floating piston pumps and positive displacement pumps.

In other embodiments, the pump is a low pressure pump. As used herein, the term "low pressure pump" refers to a pump that operates at a pressure of about 1000 psi or less. In some embodiments, a low pressure pump can be fluidly coupled to a high pressure pump. That is, in such embodiments, the low pressure pump is configured to convey the composition to the high pressure pump. In such embodiments, the low pressure pump can "step up" the pressure of the composition before it reaches the high pressure pump.

In some embodiments, the system described herein further comprises a mixing tank that is upstream of the pump and in which the fluid is formulated. In various embodiments, the pump (e.g., a low pressure pump, a high pressure pump, or a combination thereof) conveys the fluid from the mixing tank or other source of the fluid to the wellhead. In other embodiments, however, the fluid is formulated offsite and transported to a worksite, in which case the fluid is introduced to the wellhead via the pump directly from its shipping container (e.g., a truck, a railcar, a barge, or the like) or from a transport pipeline. In either case, the fluid is drawn into the pump, elevated to an appropriate pressure, and then introduced into the wellbore for delivery to the subterranean formation.

The fluids used in the methods and systems of the present disclosure may comprise any base fluid known in the art, including aqueous base fluids, non-aqueous base fluids, and any combinations thereof. The term "base fluid" refers to the major component of the fluid (as opposed to components dissolved and/or suspended therein), and does not indicate any particular condition or property of that fluids such as its mass, amount, pH, etc. Aqueous fluids that may be suitable for use in the methods and systems of the present disclosure may comprise water from any source. Such aqueous fluids may comprise fresh water, salt water (e.g., water containing one or more salts dissolved therein), brine (e.g., saturated salt water), seawater, or any combination thereof. In most embodiments of the present disclosure, the aqueous fluids comprise one or more ionic species, such as those formed by salts dissolved in water. For example, seawater and/or produced water may comprise a variety of divalent cationic species dissolved therein. In certain embodiments, the density of the aqueous fluid can be adjusted, among other purposes, to provide additional particulate transport and suspension in the compositions of the present disclosure. In certain embodiments, the pH of the aqueous fluid may be adjusted (e.g., by a buffer or other pH adjusting agent) to a specific level, which may depend on, among other factors, the types of viscosifying agents, acids, and other additives included in the fluid. One of ordinary skill in the art, with the benefit of this disclosure, will recognize when such density and/or pH adjustments are appropriate. Examples of non-aqueous fluids that may be suitable for use in the methods and systems of the present disclosure include, but are not limited to oils, hydrocarbons, organic liquids, and the like. In certain embodiments, the fracturing fluids may comprise a mixture of one or more fluids and/or gases, including but not limited to emulsions, foams, and the like.

In certain embodiments, the fluids used in the methods and systems of the present disclosure optionally may comprise any number of additional additives. Examples of such additional additives include, but are not limited to salts, surfactants, acids, additional proppant particulates (including proppant particulates that do not comprise an MOF), diverting agents, fluid loss control additives, gas, nitrogen, carbon dioxide, surface modifying agents, tackifying agents, foamers, corrosion inhibitors, scale inhibitors, catalysts, clay control agents, biocides, friction reducers, antifoam agents, bridging agents, flocculants, $H_2S$ scavengers, $CO_2$ scavengers, oxygen scavengers, lubricants, additional viscosifiers, breakers, weighting agents, relative permeability modifiers, resins, wetting agents, coating enhancement agents, filter cake removal agents, antifreeze agents (e.g., ethylene glycol), and the like. In certain embodiments, one or more of these additional additives (e.g., a crosslinking agent) may be added to the fluid and/or activated after the viscosifying agent has been at least partially hydrated in the fluid. A person skilled in the art, with the benefit of this disclosure, will recognize the types of additives that may be included in the fluids of the present disclosure for a particular application.

In certain embodiments, the composition of the present disclosure comprises a binder. In certain embodiments, examples of suitable binders include, but are not limited to hydrated aluminum-containing binders, titanium dioxide, hydrated titanium dioxide, clay minerals, alkoxysilanes, amphiphilic substances, graphite, hydrated alumina or other aluminum-containing binders, silicon compounds, mixtures of silicon and aluminum compounds, and any combinations thereof.

The present disclosure in some embodiments provides methods for using the fluids to carry out a variety of subterranean treatments, including but not limited to hydraulic fracturing treatments, acidizing treatments, and drilling operations. In some embodiments, the fluids of the present disclosure may be used in treating a portion of a subterranean formation, for example, in acidizing treatments such as matrix acidizing or fracture acidizing. In certain embodiments, a fluid may be introduced into a subterranean formation. In some embodiments, the fluid may be introduced into a wellbore that penetrates a subterranean formation. In some embodiments, the fluid may be introduced at a pressure sufficient to create or enhance one or more fractures within the subterranean formation (e.g., hydraulic fracturing).

The compositions of the present disclosure may be prepared using any suitable method and/or equipment (e.g., blenders, mixers, stirrers, etc.) known in the art at any time prior to their use. The compositions may be prepared at a well site or at an offsite location.

The methods and compositions of the present disclosure may be used during or in conjunction with any subterranean operation. For example, the methods and/or compositions of the present disclosure may be used in the course of a fracturing treatment. In certain embodiments, the MOF functions as a proppant, or a particulate solid used for propping open the fractures in a subterranean formation. In certain embodiments, the MOF is suspended in at least a portion of the fracturing fluid so that the particulate solids are deposited in the fractures when the fracturing fluid reverts to a thin fluid to be returned to the surface. The proppant deposited in the fractures functions to prevent the fractures from fully closing and maintains conductive channels through which produced hydrocarbons can flow. In certain embodiments, the detectable component or components of the MOF renders the proppant traceable for determining fracture geometry, growth, and/or conditions in the subterranean formation. Other suitable subterranean operations in which the methods and/or compositions of the present disclosure may be used include, but are not limited to acidizing treatments (e.g., matrix acidizing and/or fracture acidizing), hydrajetting treatments, sand control treatments (e.g., gravel packing), "frac-pack" treatments, fracturing fluids, and other operations where MOFs as may be useful.

Figure 2:
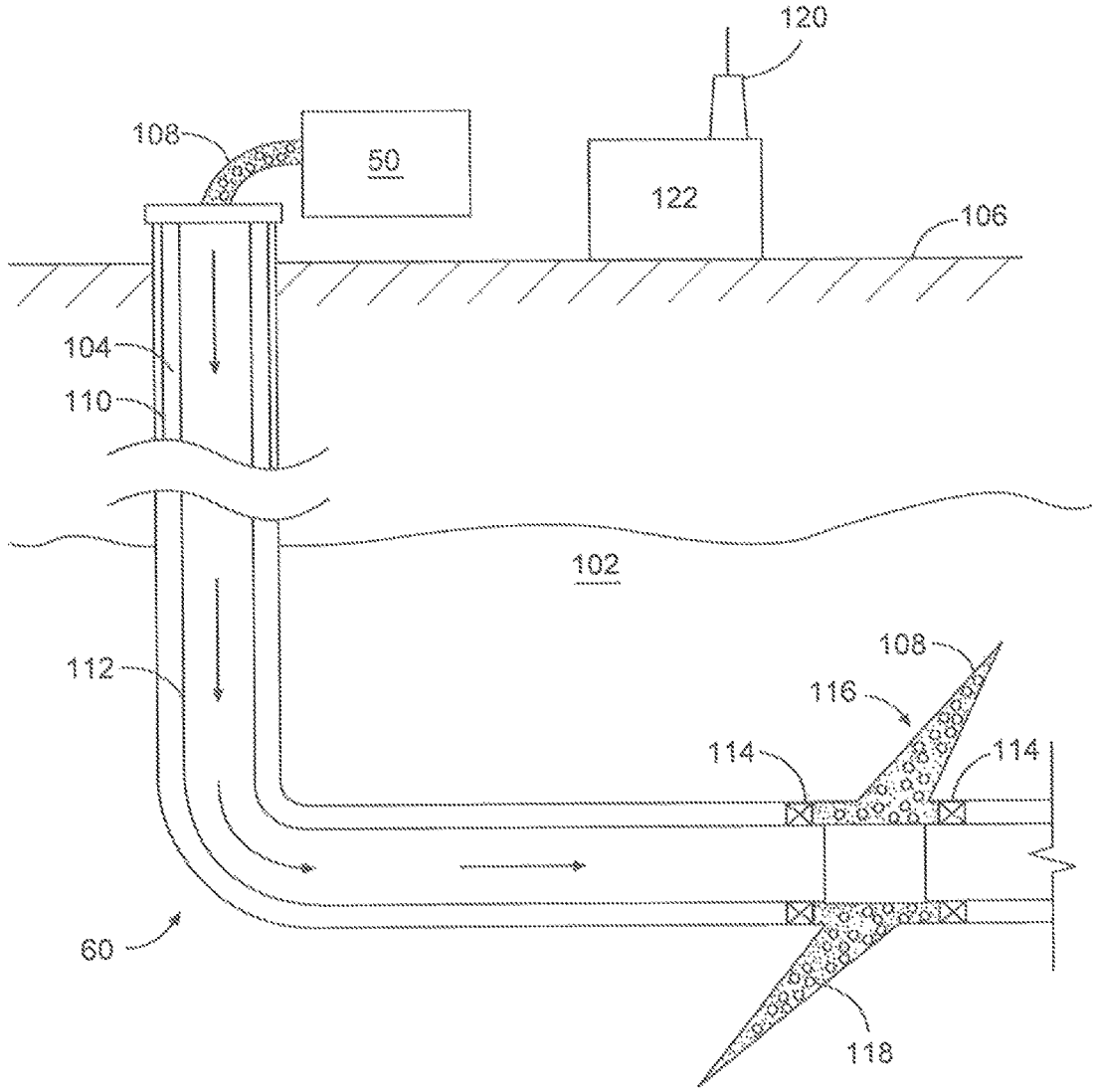
FIG. 2 is a diagram illustrating an example of a subterranean formation in which a fracturing operation may be performed in accordance with certain embodiments of the present disclosure.

FIG. 2 shows the well 60 during a fracturing operation in a portion of a subterranean formation of interest 102 surrounding a wellbore 104. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 may include horizontal, vertical, slant, curved, and other types of wellbore geometries and orientations, and the fracturing treatment may be applied to a subterranean zone surrounding any portion of the wellbore. The wellbore 104 may comprise a casing 110 that is cemented or otherwise secured to the wellbore wall. The wellbore 104 can be uncased or include uncased sections. Perforations can be formed in the casing 110 to allow fracturing fluids and/or other materials to flow into the subterranean formation 102. In cased wells, perforations can be formed using shape charges, a perforating gun, hydro-jetting, and/or other tools.

The well 60 is shown with a working string 112 depending from the surface 106 into the wellbore 104. The pump 50 is coupled to a working string 112 to pump the fracturing fluid 108 into the wellbore 104. In certain embodiments, the fracturing fluid 108 may be formulated in a mixing tank (not shown) before entering the wellbore 104. The working string 112 may comprise coiled tubing, jointed pipe, and/or other structures that allow fluid to flow into the wellbore 104. The working string 112 may comprise flow control devices, bypass valves, ports, and/or other tools or well devices that control a flow of fluid from the interior of the working string 112 into the subterranean formation 102. For example, the working string 112 may comprise ports adjacent the wellbore wall to communicate the fracturing fluid 108 directly into the subterranean formation 102, and the working string 112 may comprise ports that are spaced apart from the wellbore wall to communicate the fracturing fluid 108 into an annulus in the wellbore between the working string 112 and the wellbore wall.

The working string 112 and/or the wellbore 104 may comprise one or more sets of packers 114 that seal the annulus between the working string 112 and wellbore 104 to define an interval of the wellbore 104 into which the fracturing fluid 108 will be pumped. FIG. 2 shows two packers 114, one defining an uphole boundary of the interval and one defining the downhole end of the interval. When the fracturing fluid 108 is introduced into wellbore 104 (e.g., in FIG. 2, the area of the wellbore 104 between packers 114) at a sufficient hydraulic pressure, one or more fractures 116 may be created in the subterranean formation 102. The solid particles comprising a MOF 118 present in the fracturing fluid 108 may enter the fractures 116 where they may remain after the fracturing fluid 108 flows out of the wellbore 104. In some embodiments, the solid particle comprising a MOF 118 may comprise the MOF 201 from FIG. 1. These particulates may "prop" fractures 116 such that fluids may flow more freely through the fractures 116. One or more signals emitted, reflected, adsorbed, and/or altered by the detectable component of the solid particle comprising a MOF 118 may be detected by the sensor 120 and communicated to the imaging equipment 122. The imaging equipment 122 may generate an image of the geometry of at least part of the subterranean formation.

Imaging equipment 122 may include, but is not limited to computer processors, personal computer systems, desktop computers, laptops, notebooks, mainframe computer systems, handheld computers, workstations, tablets, application servers, storage devices, computing clusters, or any type of imaging, computing, or electronic device suitable for imaging, mapping, logging, or other imaging, tracing, and/or monitoring methods. In certain embodiments, imaging equipment 122 may include equipment such as that used for MRIAN™ Magnetic Resonance Imaging Analysis and/or ReadyView™ Open Hole Imaging System as marketed by Halliburton Energy Services, Inc. The imaging equipment 122 may, in certain embodiments, provide data to monitoring software at the well site 60 or at an offsite, remote location. Examples of suitable monitoring software may include, but are not limited to Halliburton's INSITE Anywhere® web delivery system.

It should be noted that while FIG. 2 generally depicts the imaging equipment 122 and sensor 120 on the surface, it could be elsewhere, including, but not limited to various locations in wellbore 104 (e.g., on the working string 112 or a wireline device (not shown)) or in another subterranean region of formation 102. For example, in certain embodiments, the imaging equipment 122 and/or sensor 120 may be located in an offset monitoring well (not shown), i.e., an existing wellbore close to well 60. In certain embodiments, the imaging equipment 122 and/or sensor 120 may be located in the offset well and may detect the signals from the solid particle comprising a MOF 118 in the wellbore 104. In other embodiments, the imaging equipment 122 may be located at the well site 60, or may be located at an offsite, remote location. In these embodiments, the sensor 120 and/or imaging equipment 122 may detect the signals from the solid particle comprising a MOF 118 using any suitable means known in the art. In certain embodiments, the imaging equipment 122 may comprise a computer processor at the well site 60 communicating with other equipment (not shown) located at an offsite, remote location. In certain embodiments, other configurations of imaging equipment, sensors, and computer processors may be employed.

The fluid of the disclosure may also directly or indirectly affect the various downhole or subterranean equipment and tools that can come into contact with the fluid during operation. Such equipment and tools can include wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, and the like), logging tools and related telemetry equipment, actuators (e.g., electromechanical devices, hydromechanical devices, and the like), sliding sleeves, production sleeves, plugs, screens, filters, flow control devices (e.g., inflow control devices, autonomous inflow control devices, outflow control devices, and the like), couplings (e.g., electro-hydraulic wet connect, dry connect, inductive coupler, and the like), control lines (e.g., electrical, fiber optic, hydraulic, and the like), surveillance lines, drill bits and reamers, sensors or distributed sensors, downhole heat exchangers, valves and corresponding actuation devices, tool seals, packers, cement plugs, bridge plugs, and other wellbore isolation devices or components, and the like. Any of these components can be included in the systems and apparatuses generally described above.

While not specifically illustrated herein, the disclosed methods and compositions may also directly or indirectly affect any transport or delivery equipment used to convey the compositions to a system such as, for example, any transport vessels, conduits, pipelines, trucks, tubulars, and/or pipes used to fluidically move the compositions from one location to another, any pumps, compressors, or motors used to drive the compositions into motion, any valves or related joints used to regulate the pressure or flow rate of the compositions, and any sensors (i.e., pressure and temperature), gauges, and/or combinations thereof, and the like.

To facilitate a better understanding of the present disclosure, the following examples of certain aspects of preferred embodiments are given. The following examples are not the only examples that could be given according to the present disclosure and are not intended to limit the scope of the disclosure or claims.

An embodiment of the present disclosure is a method comprising:

introducing a fluid into a wellbore penetrating at least a portion of a subterranean formation, the fluid comprising a base fluid and a solid particle comprising a metal-organic framework comprising at least one detectable component, wherein the metal-organic framework further comprises at least one metal ion and an organic ligand that is at least bidentate and that is bonded to the metal ion; and detecting one or more signals from the at least one detectable component.

Another embodiment of the present disclosure is a method comprising: introducing a fluid into a wellbore penetrating at least a portion of a subterranean formation, the fluid comprising a base fluid and a solid particle comprising a metal-organic framework comprising at least one detectable component, wherein the metal-organic framework further comprises at least one metal ion and an organic ligand that is at least bidentate and that is bonded to the metal ion; depositing the solid particle comprising the metal-organic framework in at least the portion of the subterranean formation; and detecting one or more signals from the at least one detectable component.

Another embodiment of the present disclosure is a system comprising: a metal-organic framework located in a portion of a subterranean formation at the well site comprising at least one detectable component, wherein the metal-organic framework comprises at least one metal ion and an organic ligand that is at least bidentate and that is bonded to the metal ion; one or more sensors detecting one or more signals from the at least one detectable component; and imaging equipment communicating with the one or more sensors, wherein the one or more sensors are located at a well site.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method comprising:

introducing a fluid into a wellbore penetrating at least a portion of a subterranean formation, the fluid comprising a base fluid and a solid particle comprising a metal-organic framework comprising at least one detectable component, wherein the metal-organic framework is not coated or encapsulated and further comprises at least one metal ion and an organic ligand that is at least bidentate and that is bonded to the metal ion; and detecting one or more signals from the at least one detectable component.

2. The method of claim 1 wherein the at least one detectable component comprises a metal ion selected from the group consisting of $Li^{+}$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Ti^{2+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^{+}$, $Ni^{2+}$, $Ni^{+}Pd^{4+}$, $Pd^{2+}$, $Pd^{+}$, $Pt^{4+}$, $Pt^{2+}$, $Pt^{+}$, $Cu^{2+}$, $Cu^{+}$, $Ag^{+}$, $Au^{+}$, $Zn^{2+}$, $Cd^{2+}$, $Hg^{2+}$, $Hg^{+}$, $Al^{3+}$, $Ga^{3+}$, $In^{3+}$, $Tl^{3+}$, $Tl^{+}$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^{+}$, $Sb^{5+}$, $Sb^{3+}$, $Sb^{+}$, $Bi^{5+}$, $Bi^{3+}$, $Bi^{+}$, $Gd^{3+}$, $Eu^{3+}$, $Tb^{3+}$, and any combination thereof.

3. The method of claim 1 wherein the organic ligand comprises the at least one detectable component.

4. The method of claim 1 wherein the at least one detectable component is selected from the group consisting of: a luminescent quantum dot, a perhalogenated compound, a light-absorbing dye, a fluorescent dye, a short-chain aliphatic compound, a chelating agent, a high thermal neutron capture compound, $^{13}C$, $^{14}C$, $^{1}H$, $^{2}H$, $^{15}N$, $^{31}P$, $^{17}O$, $^{18}O$, $^{19}F$, $^{33}S$, $^{35}Cl$, $^{37}Cl$, $^{79}Br$, $^{81}Br$, $^{127}I$, and any combination thereof.

5. The method of claim 1 wherein the at least one detectable component comprises a guest molecule within at least one pore space in the metal-organic framework.

6. The method of claim 5 wherein the guest molecule is selected from the group consisting of: $Li^{+}$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Ti^{2+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Re^{3+}$, $Re^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^{+}$, $Ni^{2+}$, $Ni^{+}$, $Pd^{4+}$, $Pd^{2+}$, $Pd^{+}$, $Pt^{4+}$, $Pt^{2+}$, $Pt^{+}$, $Cu^{2+}$, $Cu^{+}$, $Ag^{+}$, $Au^{+}$, $Zn^{2+}$, $Cd^{2+}$, $Hg^{2+}$, $Hg^{+}$, $Al^{3+}$, $Ga^{3+}$, $In^{3+}$, $Tl^{3+}$, $Tl^{+}$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^{+}$, $Sb^{5+}$, $Sb^{3+}$, $Sb^{+}$, $Bi^{5+}$, $Bi^{3+}$, $Bi^{+}$, $Eu^{3+}$, $Tb^{3+}$, and any combination thereof.

7. The method of claim 1 wherein detecting the one or more signals comprises applying a magnetic field to at least the portion of the subterranean formation.

8. The method of claim 1 wherein the at least one detectable component is at least partially radioactive.

9. The method of claim 1 wherein the detecting comprises neutron capture.

10. The method of claim 1 wherein the detecting comprises an x-ray source.

11. The method of claim 1 wherein the detectable component is detected using one or more sensors.

12. The method of claim 1 further comprising generating an image of at least the portion of the subterranean formation using the one or more signals from the at least one detectable component.

13. The method of claim 1 wherein the intensity of the one or more signals depends, at least in part, on at least one condition in at least the portion of the subterranean formation.

14. The method of claim 1 wherein the introducing comprises penetrating the fluid into one or more fractures in at least the portion of the subterranean formation.

15. The method of claim 1 wherein the fluid is introduced into the wellbore using one or more pumps at or above a pressure sufficient to create or enhance one or more fractures in at least the portion of the subterranean formation.

16. The method of claim 1 wherein the metal-organic framework is a proppant particulate.

17. A method comprising:

introducing a fluid into a wellbore penetrating at least a portion of a subterranean formation, the fluid comprising a base fluid and a solid particle comprising a metal-organic framework comprising at least one detectable component, wherein the metal-organic framework is not coated or encapsulated and further comprises at least one metal ion and an organic ligand that is at least bidentate and that is bonded to the metal ion;

depositing the solid particle comprising the metal-organic framework in at least the portion of the subterranean formation; and detecting one or more signals from the at least one detectable component.

18. The method of claim 17, wherein at least the portion of the subterranean formation comprises one or more fractures in the subterranean formation.

19. A system comprising:

a metal-organic framework located in a portion of a subterranean formation at the well site comprising at least one detectable component, wherein the metal-organic framework is not coated or encapsulated and comprises at least one metal ion and an organic ligand that is at least bidentate and that is bonded to the metal ion;

one or more sensors detecting one or more signals from the at least one detectable component; and imaging equipment communicating with the one or more sensors, wherein the one or more sensors are located at a well site.

20. The system of claim 19 wherein the at least one detectable component is selected from the group consisting of: a luminescent quantum dot, a perhalogenated compound, a light-absorbing dye, a fluorescent dye, a short-chain aliphatic compound, a mechanically-interlocked molecular architecture, a chelating agent, a high thermal neutron capture compound, $^{13}C$, $^{14}C$, $^{1}H$, $^{2}H$, $^{15}N$, $^{31}P$, $^{17}O$, $^{18}O$, $^{19}F$, $^{33}S$, $^{35}Cl$, $^{37}Cl$, $^{79}Br$, $^{81}Br$, $^{127}I$, $Li^{+}$, $Mg^{2+}$, $Ca^{2+}$, $Sr^{2+}$, $Ba^{2+}$, $Sc^{3+}$, $Y^{3+}$, $Ti^{4+}$, $Ti^{3+}$, $Ti^{2+}$, $Zr^{4+}$, $Zr^{3+}$, $Zr^{2+}$, $Hf^{4+}$, $V^{5+}$, $V^{4+}$, $V^{3+}$, $V^{2+}$, $Nb^{3+}$, $Ta^{3+}$, $Cr^{3+}$, $Mo^{3+}$, $W^{3+}$, $Mn^{3+}$, $Mn^{2+}$, $Re^{3+}$, $Re^{2+}$, $Fe^{3+}$, $Fe^{2+}$, $Ru^{3+}$, $Ru^{2+}$, $Os^{3+}$, $Os^{2+}$, $Co^{3+}$, $Co^{2+}$, $Rh^{2+}$, $Rh^{3+}$, $Ir^{2+}$, $Ir^{+}$, $Ni^{2+}$, $Ni^{+}$, $Pd^{4+}$, $Pd^{2+}$, $Pd^{+}$, $Pt^{4+}$, $Pt^{2+}$, $Pt^{+}$, $Cu^{2+}$, $Cu^{+}$, $Ag^{+}$, $Au^{+}$, $Zn^{2+}$, $Cd^{2+}$, $Hg^{2+}$, $Hg^{+}$, $Al^{3+}$, $Ga^{3+}$, $In^{3+}$, $Tl^{3+}$, $Tl^{+}$, $Si^{4+}$, $Si^{2+}$, $Ge^{4+}$, $Ge^{2+}$, $Sn^{4+}$, $Sn^{2+}$, $Pb^{4+}$, $As^{5+}$, $As^{3+}$, $As^{+}$, $Sb^{5+}$, $Sb^{3+}$, $Sb^{+}$, $Bi^{5+}$, $Bi^{3+}$, $Bi^{+}$, $Gd^{3+}$, $Eu^{3+}$, $Tb^{3+}$, and any combination thereof.

* * * * *